US008312813B2

(12) United States Patent
McDermott et al.

(10) Patent No.: US 8,312,813 B2
(45) Date of Patent: Nov. 20, 2012

(54) DEPLOYABLE FAIRING AND METHOD FOR REDUCING AERODYNAMIC DRAG ON A GUN-LAUNCHED ARTILLERY SHELL

(75) Inventors: Brian K. McDermott, Woodinville, WA (US); Kevin R. Greenwood, Tucson, AZ (US); James D. Streeter, Tucson, AZ (US)

(73) Assignees: Raytheon Company, Waltham, MA (US); General Dynamics Ordnance and Tactical Systems, Bothell, WA (US)

( * ) Notice: Subject to any disclaimer, the term of this patent is extended or adjusted under 35 U.S.C. 154(b) by 289 days.

(21) Appl. No.: 12/847,722

(22) Filed: Jul. 30, 2010

(65) Prior Publication Data

US 2011/0024549 A1 Feb. 3, 2011

Related U.S. Application Data

(60) Provisional application No. 61/230,527, filed on Jul. 31, 2009.

(51) Int. Cl.
*F42B 10/44* (2006.01)

(52) U.S. Cl. ..... 102/490; 244/3.27; 244/3.24; 102/473

(58) Field of Classification Search ..... 102/473, 102/490, 501; 244/3.24, 3.26, 3.27, 3.28, 244/3.29, 3.3
See application file for complete search history.

(56) References Cited

U.S. PATENT DOCUMENTS 229,499 A * 6/1880 Turner ..... 244/3.27
656,933 A * 8/1900 Brown ..... 244/3.3
3,292,879 A * 12/1966 Seward ..... 244/3.3
3,347,491 A * 10/1967 Auguste et al. ..... 244/3.27
3,412,962 A * 11/1968 Killian ..... 244/130
4,348,957 A 9/1982 White
4,520,972 A * 6/1985 Diesinger et al. ..... 244/3.1
4,674,706 A 6/1987 Hall
5,388,788 A * 2/1995 Rudolph ..... 244/215
6,492,632 B1 12/2002 Pollin
6,571,715 B1 * 6/2003 Bennett et al. ..... 102/439
6,657,174 B1 12/2003 Olsson
6,880,780 B1 * 4/2005 Perry et al. ..... 244/3.27
6,886,775 B2 5/2005 Johnsson (Continued)

FOREIGN PATENT DOCUMENTS

DE 4101960 A1 7/1992

(Continued)

*Primary Examiner* — Bret Hayes
*Assistant Examiner* — Joshua Freeman
(74) *Attorney, Agent, or Firm* — Eric A. Gifford

(57) ABSTRACT

A deployable fairing is driven off of high-pressure gun gases to reduce aerodynamic drag and extend the range of the artillery shell. An artillery shell is provided with a fabric fairing and a piston attached thereto in a rear section of the shell in a stowed state and a chamber. During launch high-pressure gun gasses are captured and stored in the chamber. Once the shell clears the end of the artillery tube, the pressure aft of the shell drops from the high pressure inside the tube to atmospheric pressure outside the tube. The high pressure gun gasses stored in the chamber act over the top surface of the piston to drive the piston aft against the much lower pressure behind the projectile to deploy the fabric fairing attached thereto to reduce the base area of the projectile creating or extending the boat-tail of the shell, hence reduce aerodynamic drag. The aft driven piston engages a locking mechanism that locks the piston in a deployed position.

20 Claims, 15 Drawing Sheets

U.S. PATENT DOCUMENTS

| | | | | |
|---|---|---|---|---|
| 7,083,140 | B1 * | 8/2006 | Dooley | 244/3.27 |
| 7,997,205 | B2 * | 8/2011 | Greenwood et al. | 102/490 |
| 2001/0030260 | A1 * | 10/2001 | Niemeyer et al. | 244/3.26 |
| 2003/0146342 | A1 * | 8/2003 | Hellman | 244/3.27 |
| 2004/0011919 | A1 * | 1/2004 | Johnsson et al. | 244/3.29 |
| 2004/0011920 | A1 * | 1/2004 | Johnsson et al. | 244/3.29 |
| 2010/0282116 | A1 * | 11/2010 | Greenwood et al. | 102/501 |

FOREIGN PATENT DOCUMENTS

| | | | | |
|---|---|---|---|---|
| GB | 10325 | | | 0/1912 |
| GB | 2394029 | A | * | 4/2004 |
| WO | 0206759 | A1 | | 1/2002 |

* cited by examiner

T=~20ms

DEPLOYABLE FAIRING AND METHOD FOR REDUCING AERODYNAMIC DRAG ON A GUN-LAUNCHED ARTILLERY SHELL

CROSS-REFERENCE TO RELATED APPLICATION

This application claims benefit of priority under 35 U.S.C. 119(e) to U.S. Provisional Application No. 61/230,527, entitled "Deployable Boat-Tail Device for Use on Projectiles," filed on Jul. 31, 2009, the entire contents of which are incorporated by reference.

BACKGROUND OF THE INVENTION

1. Field of the Invention

This invention relates to artillery shells and more particularly to an apparatus and method for reducing drag on a gun-launched artillery shell.

2. Description of the Related Art

For reasons concerning firing technology, artillery shells have a rear surface at right angles to the shell axis. It is well known that a rear surface that does not taper, or tapers too quickly, will cause the airflow to separate from the projectile at that location resulting in low pressure behind the shell. The low-pressure region acts like a partial vacuum over the entire aft area of the shell, which increases drag thus limiting the maximum range of the shell. The larger the area that the low pressure acts upon the greater the applied drag force.

The "base-bleed" technique has been much used in recent years to increase the range of air-defense and artillery shells without having to increase muzzle velocity and thereby increase the size of the propellant charge to a level the gun in question would not withstand. The base-bleed technique allows gas to flow out from the rear surface of the shell preferably at a flow rate that re-pressurizes the area behind the shell reducing the drag proportional to the amount of pressure recovered by filling the low-pressure region with gas from the base-bleed gas source. Although the base-bleed device is similar to a supplementary rocket motor with its propellant loaded interior chamber and its central flow outlet, its function is totally different from that used in shells which are fitted with supplementary rocket motors known as sustainers to increase firing range. Such rocket motors are loaded with pure rocket propellant and they provide the shell with a velocity increment, while the base-bleed device is loaded with a slow burning propellant that is intended only to eliminate drag during the portion of the shell trajectory the propellant is burning.

U.S. Pat. No. 6,657,174 describes an alternative to the base-bleed technique that involves extending the shell at the rear by a protruding conical tail section. The tail section consists of an inflatable part initially fitted in the rear section of the shell in compressed form and secured to the shell body, and can be folded out and inflated to the desired form and hardness by the propellant gases from a small propellant charge which is ignited at the required time. Such an inflatable section part can for example be made of Kevlar and remain in a removable cover connected to the shell up to the time it is deployed. The energy in the air allows the flow to turn the corner at the base of the shell following the side of the protruding conical tail reducing the area that the low pressure acts on. The drag force at the base of the shell is the difference in pressure from the outside, undisturbed air and the partial vacuum created by the separated airflow multiplied by the area that the pressure acts upon. The protruding conical tail effectively reduces the area the low pressure can act on reducing the drag force significantly. This tapered aft section is typically known as a boat-tail coming from the tapered back end of many boats designed to reduce their drag in water.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a deployable fairing driven off of high-pressure gun gases to reduce aerodynamic drag and extend the range of the artillery shell.

This is accomplished by providing an artillery shell with a fabric fairing and a piston attached thereto in a rear section of the shell in a stowed state and a chamber. The shell is loaded into artillery gun tube. Propellant inside the gun tube is burned producing high-pressure gun gasses that launch the shell from the gun tube. During launch the high-pressure gun gasses are captured and temporarily stored in the chamber. Once the shell clears the end of the gun tube, the pressure aft of the shell drops from the high pressure inside the tube to at or below the atmospheric pressure outside the tube. The high-pressure gun gasses stored in the chamber produce a pressure that acts on the top surface of the piston to drive the piston aft against the much lower atmospheric pressure behind the shell to deploy the fabric fairing, called a "boat-tail", which is attached thereto to reduce the area behind the shell hence reducing the aerodynamic drag. The aft driven piston engages a locking mechanism that locks the piston in a deployed position. The locking mechanism prevents the piston from rebounding and maintains the boat-tail even after the driving gas in the chamber has been exhausted.

In an embodiment, an artillery shell for launch from an artillery tube comprises a warhead, a fabric fairing fitted in a rear section of the shell in a stowed state, a chamber in a rear section of the shell, a plate attached to a rear section of the fabric fairing, a piston attached to the plate, a locking mechanism and a gas intake path coupled to the chamber. Upon firing the artillery shell from the artillery tube, high-pressure gasses flow through the gas intake path and are stored in the chamber. Once the shell clears the end of the tube, the stored high-pressure gun gases drive the piston aft into the locking mechanism to deploy the fairing.

The shell may include a cylinder that guides the piston and extends axially into the chamber. The cylinder includes one or more holes formed therein that initially allow the gas to flow from the center bore of the piston through the holes into the chamber. The gas intake path may comprise an orifice that extends through the plate, axially through a bore down the length of the piston to one or more holes in the sidewalls or top surface of the piston and through holes in the cylinder into the chamber. Alternately, the gas intake path may be directly coupled to the chamber and separate from the fairing actuator assembly. The gas that flowed into, and was stored temporarily in, the chamber now acts through holes in the cylinder and over the top surface of the piston. That pressure acting over the area at the top of the piston pushes the piston aft. The stored high pressure couples to the top of the piston to provide the driving force on the piston.

In an embodiment, the shell may include a cylinder that guides the piston and extends axially into the chamber. The gas intake path comprises an orifice that extends through the plate, axially through a bore down the length of the piston. The orifice may or may not extend through the top surface of the piston. Holes in the sidewalls of the piston are nominally aligned to holes in the sidewalls of the cylinder in the stowed state. During intake, high-pressure gun gas flows down the orifice and through the aligned holes in the cylinder and piston into the chamber. Detents may be positioned on the inner walls of the cylinder to prevent the piston from moving forward during gas intake. Once the shell clears the gun tube, the high-pressure gas in the chamber is coupled through other holes in the cylinder in front of the piston to act over the top surface of the piston. That high-pressure (relative to the low-pressure aft of the shell) acting over the area at the top of the piston drives the piston aft.

In an embodiment, the shell may include a cylinder that guides the piston and extends axially into the chamber. The gas intake path comprises an orifice that extends through the plate, axially through a bore down the length of the piston to its top surface. Castellations are positioned on the top surface of the piston around the orifice. The cylinder includes a plurality of holes nominally aligned to the void spaces between adjacent castellations. During intake, high-pressure gun gas flows down the orifice, between the castellations and through the holes in the cylinder into the chamber. Once the shell clears the gun tube, the high-pressure gas in the chamber is coupled through the holes in the cylinder and the castellations to act over the top surface of the piston. That high-pressure (relative to the low-pressure aft of the shell) acting over the area at the top of the piston drives the piston aft.

In an embodiment, a base assembly kit for a gun-launched artillery shell comprises a base assembly, a fabric fairing fitted in and attached to the aft end of the base assembly in a stowed state, a chamber, a plate attached to a rear section of the fabric fairing, a piston attached to the plate, a locking mechanism and a gas intake path coupled to the chamber. Upon firing the artillery shell from the gun tube, high-pressure gasses flow through the gas intake path and are stored in the chamber. Once the shell clears the end of the tube, the stored high-pressure gun gases act over the top surface of the piston to drive the piston aft into the locking mechanism to deploy the fairing. The shell may include a cylinder that guides the piston and extends axially into the chamber. The cylinder may include one or more holes formed therein that form a gas outlet path to expel the stored high-pressure gun gas from the chamber into the cylinder over the top surface of the piston to drive the piston aft into the locking mechanism to deploy the fairing. The gas intake path may comprise an orifice that extends through the plate, axially through the piston and through holes in the piston aligned with the holes in the cylinder. The chamber may be mounted forward of the base assembly to engage a void space in a rear section of the artillery shell or may be contained within the base assembly.

The kit comprises a base assembly threaded onto the threaded rear section of the warhead holding the obturator in place. A chamber is positioned on the base assembly forward into the warhead's void space. A piston and cylinder extend axially through the base assembly into the chamber. The piston includes an axial orifice along its length and one or more holes that are aligned to one or more holes in the cylinder when the piston is in a stowed state. An end plate is attached to the aft end of the piston with an orifice aligned with the axial orifice in the piston. A fabric fairing is fitted in the aft end of the base assembly in the stowed state; one end of the fairing is secured to the base assembly and the other end of the fairing secured to the end plate. The plate orifice, along the piston axial orifice and through the holes in the piston and cylinder form a gas intake path to store high-pressure gun gas in the chamber in the stowed state. The holes in the cylinder form a gas outlet path to expel the stored high-pressure gun gas from the chamber into the cylinder to create a high pressure that acts on the top surface of the piston to drive the piston aft into a locking mechanism to deploy the fairing to the deployed state.

These and other features and advantages of the invention will be apparent to those skilled in the art from the following detailed description of preferred embodiments, taken together with the accompanying drawings, in which:

DETAILED DESCRIPTION OF THE INVENTION

The present invention describes a deployable fairing driven off of high-pressure gun gases to reduce base drag and extend the range of the artillery shell. Base drag reduction is accomplished without the use of active propellants, either to deploy the fairing or in a base-bleed configuration.

The present invention is generally applicable to all types of artillery shells for use in all types of guns that launch artillery shells from a launch tube. Artillery shells are distinguished from rockets and missiles in that artillery shells are not self-propelled, they rely on high-pressure gun gasses created in the launch tube from the deflagration of propellant within the tube to propel the shell towards a target. The "gun" may be any configuration of a launch tube and propellant (e.g. black powder, nitroglycerine, nitrocellulose, nitroguanidine or combinations thereof) configured to generate the high-pressure gun gasses to launch the shell towards the target. Such "guns" may also be referred to as barrel, cannon, howitzer, mortar or artillery.

Figure 1:
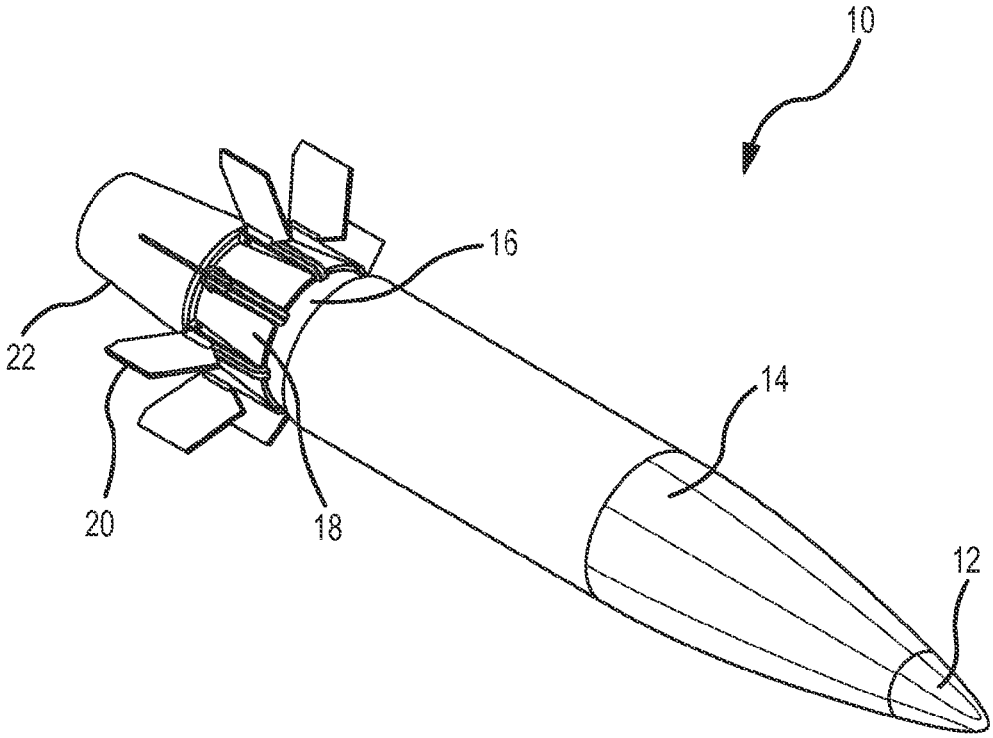
FIG. 1 is a diagram of an artillery shell with a deployed fairing.

As shown in FIG. 1, in an embodiment a typical shell 10 might include a fuze 12, a payload such as a warhead 14 that contains an explosive or other filling, an obturator 16 around the rear section of the warhead to engage an inner diameter of the artillery tube, and a base assembly 18 with potentially folding fins 20. The shell may have the shape of a cylinder topped by an ogive-shaped nose for good aerodynamic performance. The base assembly may have a taper to reduce aerodynamic drag. At launch the obturator forms a seal inside the tube so that the high-pressure gun gases efficiently launch the shell out of the tube. Upon clearing the tube, the fins if so equipped deploy to allow the shell to fly in a ballistic arc towards the target. The shell may be provided with a guidance system (e.g. GPS) to improve accuracy on target. One such shell is the M982 Excalibur® produced by Raytheon Missile Systems and BAE Systems Bofors. The invention is applicable to other shells and shell configurations.

Once in flight, a fabric fairing 22 is deployed aft of shell 10 to extend any taper of the base assembly (or to provide a taper called a boat-tail) to reduce the base area of the shell, hence reduce aerodynamic drag. The "fabric" fairing 22 may be constructed from any material that may be compressed and stowed in the rear section of the shell and rapidly deployed at launch aft of the shell. Typical fabrics might include cloth, nylon, Kevlar®, polyester and Dacron®. The fabric fairing may be a conical section that tapers from a diameter approximately equal to that of the base assembly where the fairing attaches to the base assembly to a smaller diameter aft. The length and taper of the fairing are determined by available packaging space and desired aerodynamic drag reduction performance. The present invention provides a mechanism and method for deploying the fabric fairing 22 driven off of the high-pressure gun gases. Deployment is accomplished without the use of active propellants and without inflating the fabric to hold pressure to maintain the final fairing shape. The mechanism may be configured as a "base assembly kit" that simply replaces the existing base assembly without modification to the shell or as an assembly that is integrated into the design of the shell. The "kit" approach allows the fairing to be used with the existing shell designs and large stores of shells.

Figure 2:
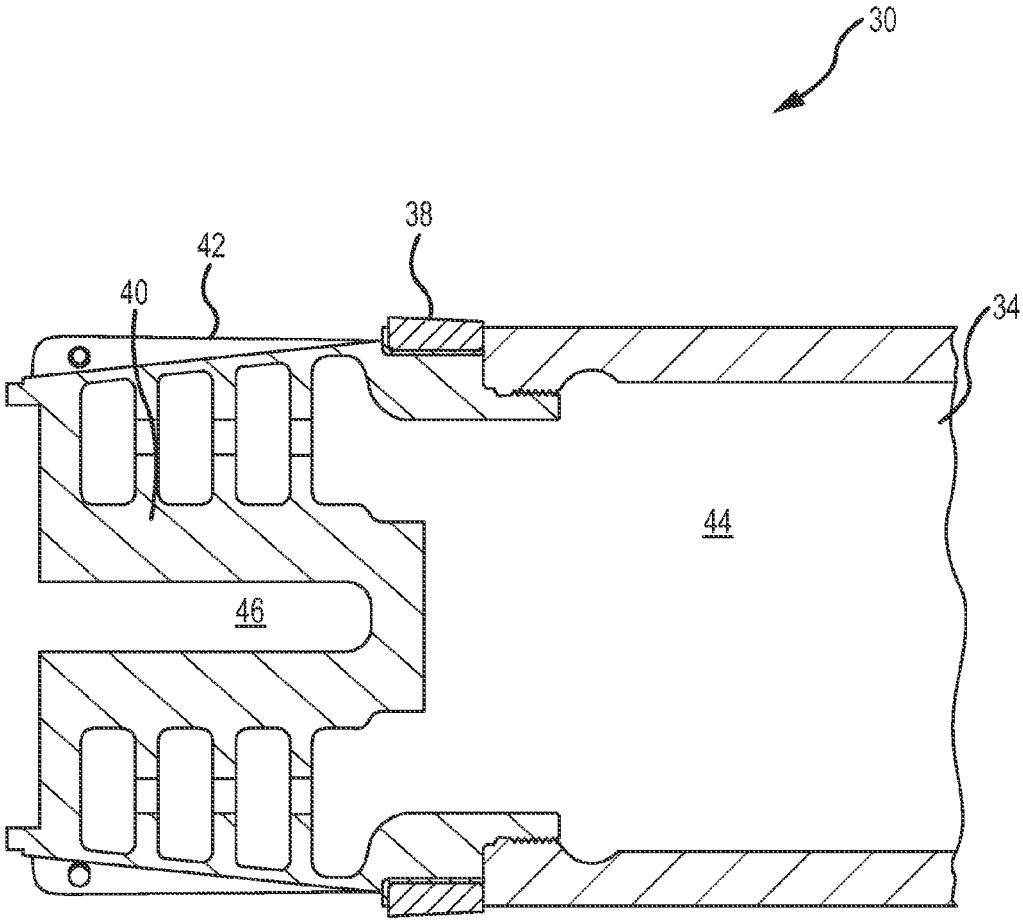
FIG. 2 is a section view of a rear section of the artillery shell sans fairing.

FIG. 2 is a section view of an embodiment of an artillery shell 30 that comprises a fuze (not shown), a warhead 34 that contains a high explosive, an obturator 38 and a base assembly 40 with folding fins 42. The rear section of the warhead and the fore section of the base assembly are provided with complementary threading. The base assembly is threaded onto the warhead to hold obturator 38 in place. In this particular shell, a rear section of the warhead defines a void space 44. This may, for example, occur to position the center of gravity of the shell. The base assembly has a cylindrical void 46 that extends along its longitudinal axis. This may, for example, exist to accommodate a base-bleed system to reduce aerodynamic drag. In other shells, the rear section of the warhead may not provide a void space and the standard base assembly may not provide the cylindrical void. The fairing deployment mechanism may be configured for use in either configuration. In either case, the cylindrical void area is modified to accommodate the cylinder/piston assembly of the fairing deployment mechanism.

Figure 3:
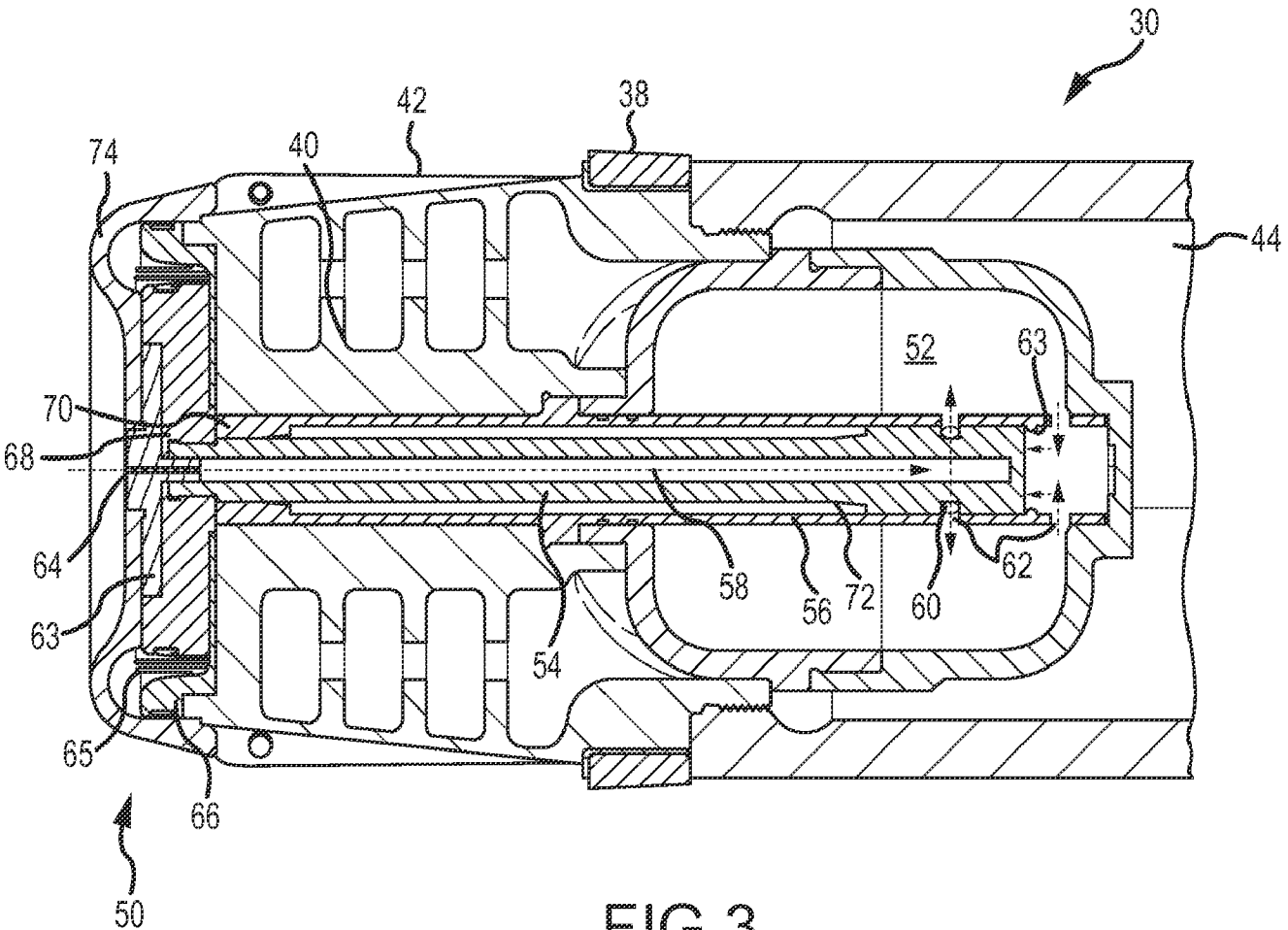
FIG. 3 is a section view of the rear section of the artillery shell with the fairing in its stowed state.
Figure 4:
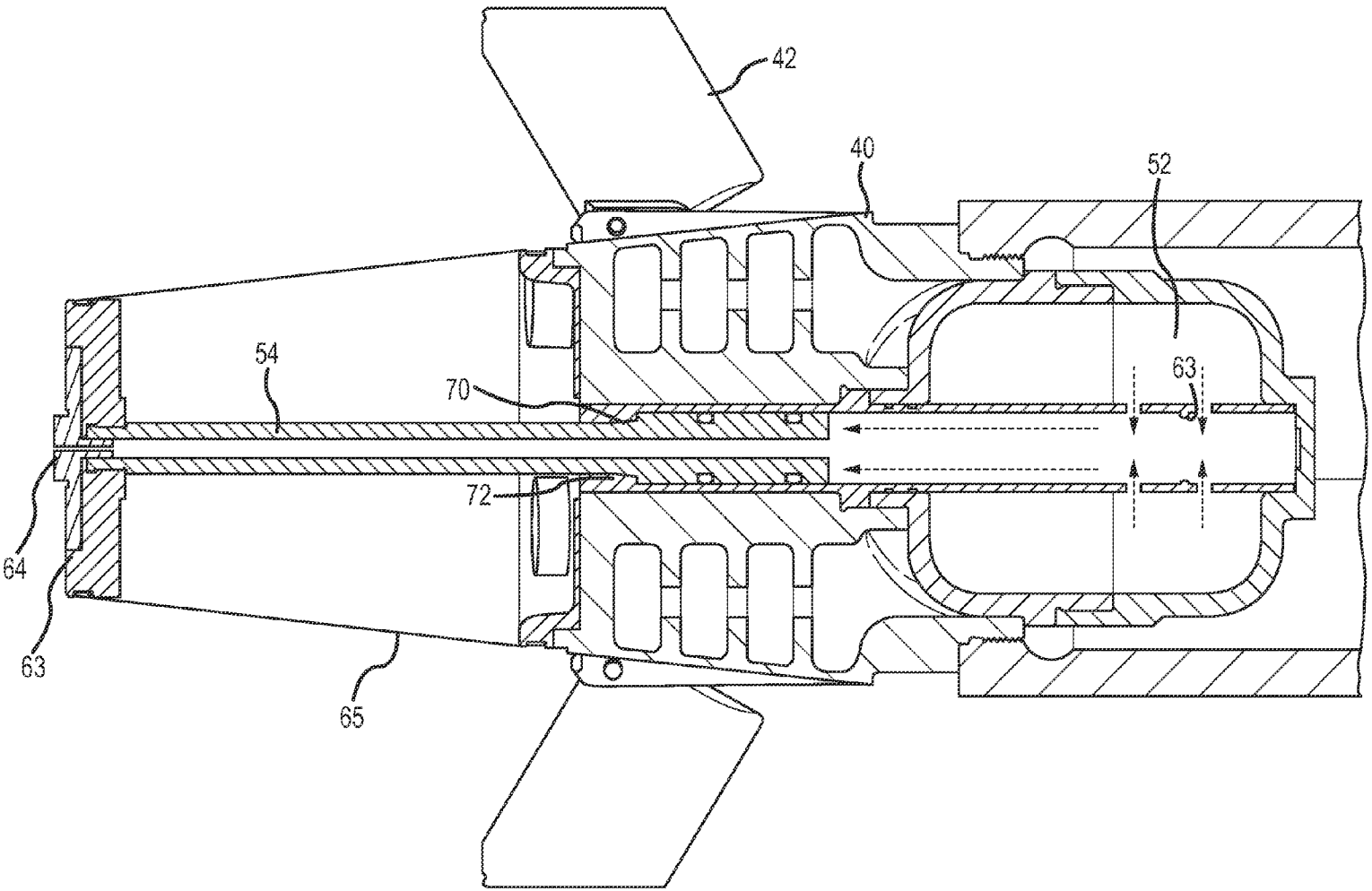
FIG. 4 is a section view of the rear section of the artillery shell with the fairing in its deployed state.
Figure 5A:
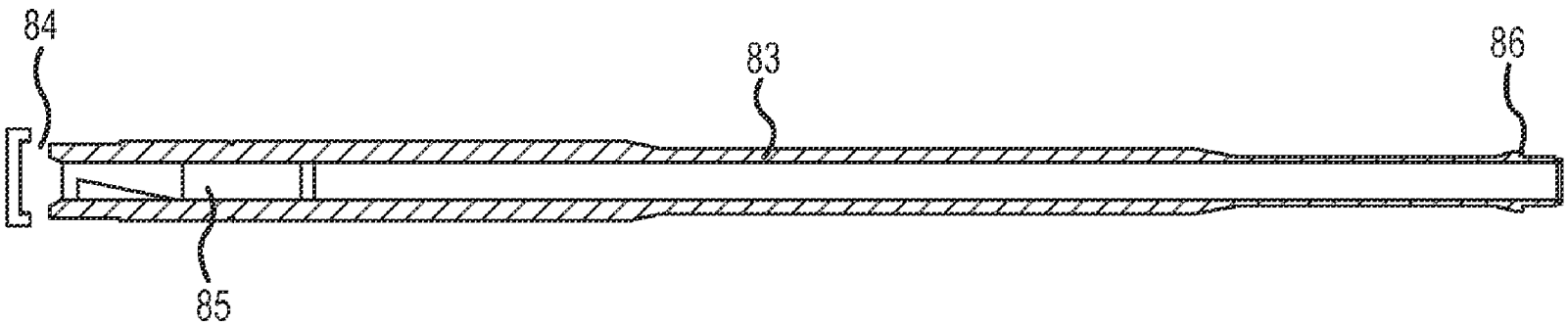
FIGS. 5*a* through 5*d* are diagrams illustrating the firing of the artillery shell to charge the fairing chamber with high-pressure gun gas and once clear of the tube to use the high-pressure gun gas to drive a piston aft to deploy the fairing.
Figure 5B:
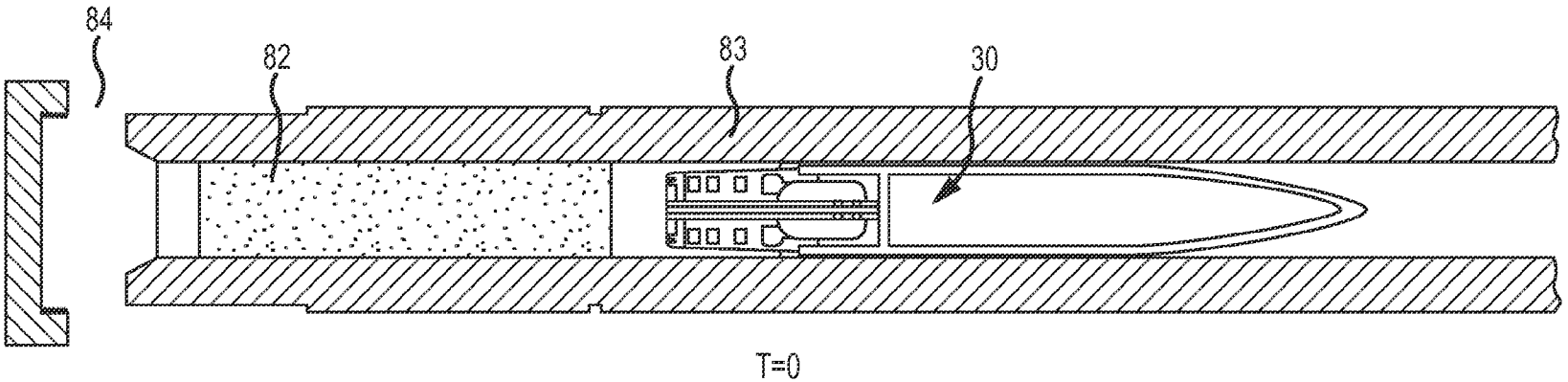
Figure 5C:
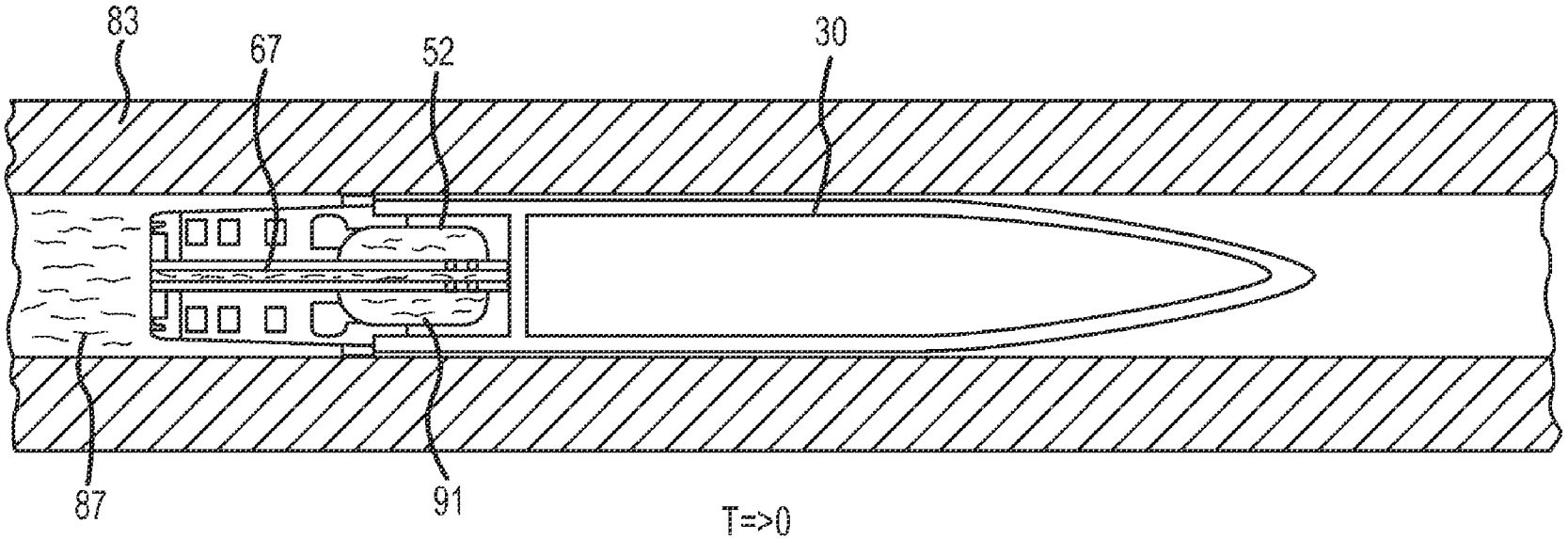
Figure 5D:
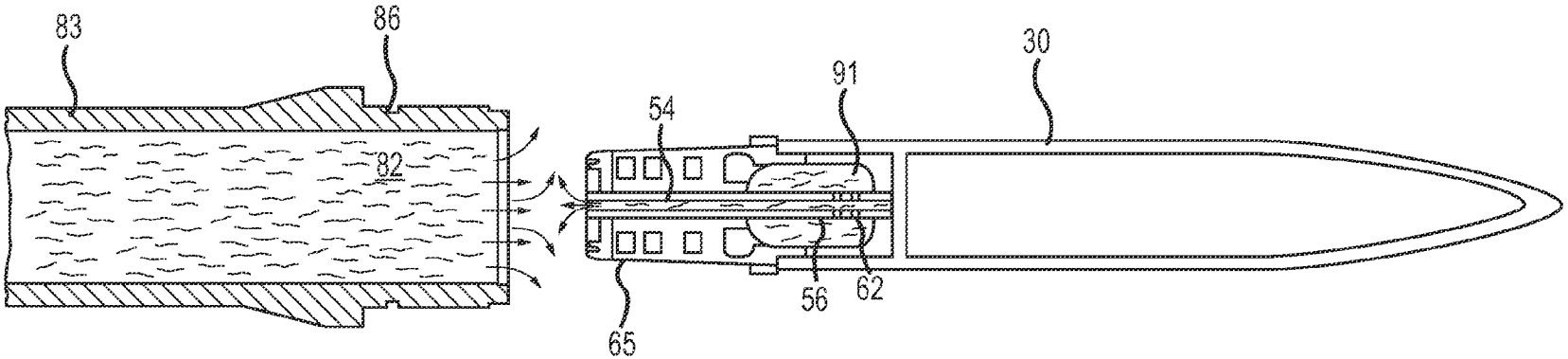

An embodiment of a fairing deployment mechanism 50 for use with artillery shell 30 is illustrated in FIG. 3 (stowed state) and FIG. 4 (deployed state). A chamber 52 is positioned on the base assembly forward into the warhead's void space 44. A piston 54 (fixed or telescoped) and cylinder 56 (that guides the movement of the piston) extend axially through the cylindrical void (modified to extend to void space 44) in the base assembly into the chamber. The forward end/top surface of the piston stands off from the closed end of the cylinder to define a volume in front of the piston. The piston includes an axial orifice 58 along its length (the orifice may or may not extend through the piston) and one or more holes 60 formed in the sidewalls of the piston that are aligned to one or more holes 62 in the cylinder when the piston is in a stowed state. An end plate 63 is attached to the aft end of the piston with an orifice 64 aligned with the axial orifice in the piston. End plate 63 may be a single integrated plate or two separate places as shown here. A fabric fairing 65 is fitted in the aft end of the base assembly in the stowed state; one end of the fairing is secured to the base assembly by a retaining ring 66 and the other end of the fairing secured to the end plate. An alternative embodiment may include fabric material that may extend over the entire plate assembly with a hole in the fabric to allow gas to flow into the piston orifice plate. Such an embodiment may require only one securing attachment at the base assembly.

The plate orifice 64, along the piston axial orifice 58 and through the aligned holes 60 and 62 in the piston and cylinder form a gas intake path to store high-pressure gun gases in the chamber in the stowed state. Detents 63 may be affixed to the cylinder at the front surface of the piston (if needed) to prevent the piston from being driven forward during intake of the high-pressure gun gasses. Alternately, a separate gas intake path may be formed directly into the chamber. Some of the holes in the cylinder 62 form a gas outlet path to expel the stored high-pressure gun gas from the chamber into the cylinder to pressurize the volume in front of the piston to act on the top surface of the piston to drive the piston aft into a locking mechanism 68 to deploy the fairing to and hold the fairing in the deployed state. As the piston moves aft the holes in the sidewalls of the piston and cylinder are misaligned preventing high-pressure gas from reversing directing into the orifice. Different configurations of holes (or vents, slots, orifices, castellations, etc.) in the piston and cylinder may be used to capture and direct high-pressure gas into the chamber and then to direct the high-pressure gas in front of the piston and over the top surface of the piston to act on and drive the piston aft. The capture and temporary storage of the high pressure gun gases pressurizes the volume in front of the top surface of the piston. Storage of such high pressure gun gases in the chamber provides sufficient volume to provide the driving force needed to drive the piston aft to deploy the fairing. If the plate orifice 64 extends through to the top surface of the piston, the orifice is suitably designed to limit leakage from the chamber to the atmosphere during deployment.

Locking mechanism 68 may, as shown here, comprises complementary internal taper 70 of the cylinder and external taper 72 of the piston. Alternately, other locking mechanisms are envisioned such as a detent pin that engages the piston. If the piston telescopes, the telescoping mechanism itself may provide the locking mechanism. The locking mechanism suitably serves a dual purpose of first preventing the piston from travelling too far aft and then preventing the piston from moving back toward its stowed position collapsing the fairing. A cover 74 covers the rear section of the base assembly to protect the fabric fairing from the gun gasses at launch. The cover falls away to allow the fairing to deploy.

Figure 6:
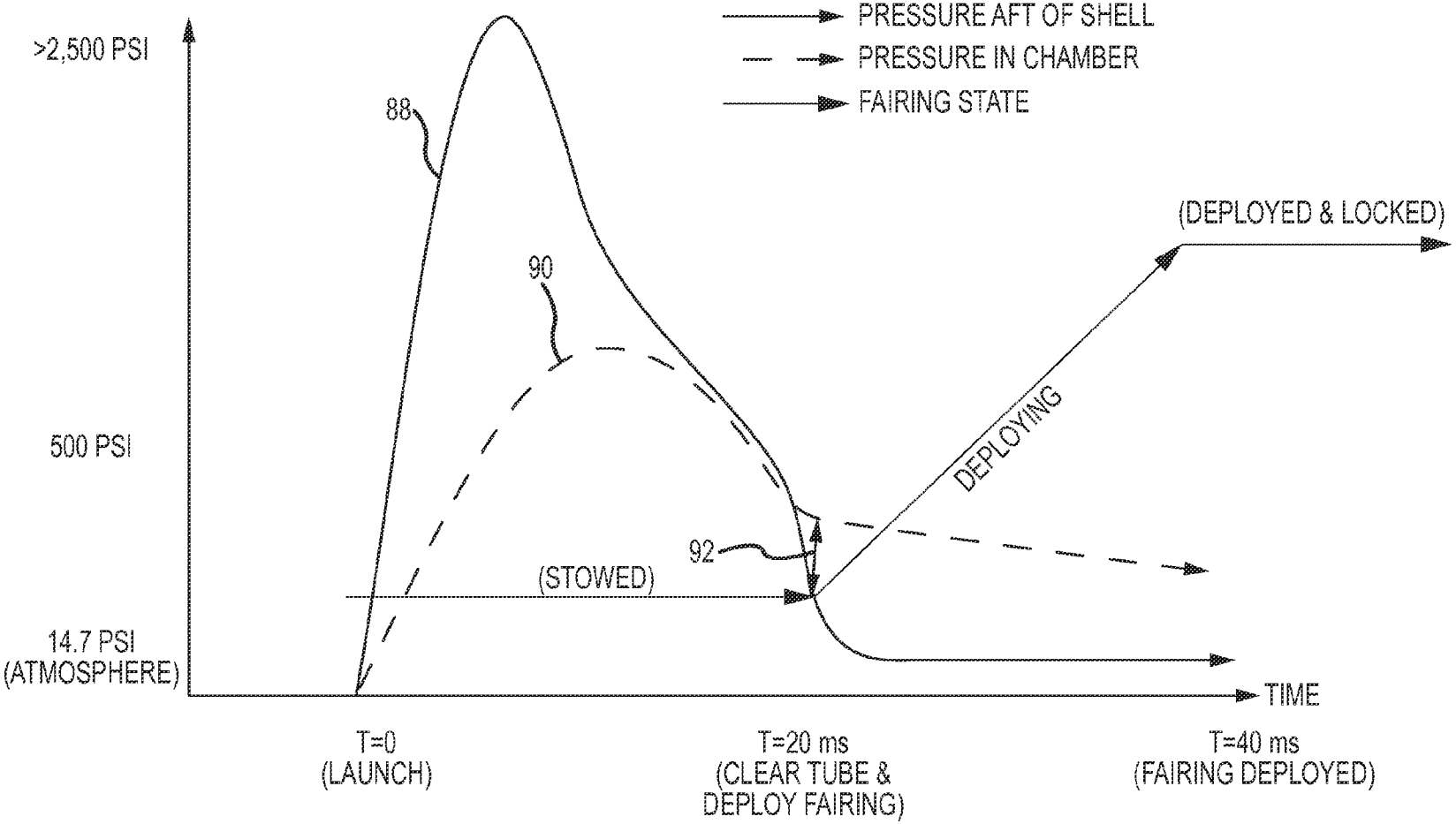
FIG. 6 is a plot of the aft and chamber pressures and state of the fairing during the launch and deployment sequences.

FIGS. 5*a* through 5*d* illustrate the firing of the artillery shell 30 by deflagration of a propellant 82 in a launch tube 83 to charge the fairing chamber with high-pressure gun gases 87 and once clear of the tube to use the high-pressure gun gasses stored in chamber 91 to drive the piston aft to deploy the fairing. FIG. 6 is a plot of the aft and chamber pressures 88 and 90 and state of the fairing during the launch and deployment sequences.

A gun includes launch tube 83 and a breech 84 for loading the shell 30 and propellant 82 into a chamber 85. The end of the launch tube is referred to as the "muzzle" 86. At T=0, propellant 82 is ignited inside launch tube 83 aft of shell 30. This produces high-pressure gun gasses 87 that are trapped in the launch tube by the shell's obturator. Typical pressures 88 aft of the gun exceed 2,500 PSI up to about 55,000 PSI. The high-pressure forces the shell 30 down the launch tube 83. A portion 91 of the high-pressure gas 87 flows through the gas intake path 67 (plate orifice, piston axial orifice and cylinder holes) into the chamber 52. The gas 91 inside the chamber may, for example, reach pressures 90 600-700 PSI or higher. The acceleration of the shell through the tube and charging of the chamber may take on the order of 20 ms.

In this example, at T=20 ms the shell clears the end or "muzzle" of the launch tube. At this point, the aft pressure 88 drops from the tube pressure (>2,500 PSI) to atmospheric pressure (approximately 14.7 PSI). This creates a pressure differential 92 between the pressure 90 of the gun gasses 91 stored in the chamber and the atmospheric pressure 88 aft of the shell. This pressure differential 92 drives the piston 54 aft into the locking mechanism to deploy the fairing 65. More precisely, the high-pressure gas 91 is expelled from the chamber 52 through the holes 62 in the cylinder 56 to drive the piston 54 aft. The plate orifice 64 in the endplate 63 is suitably designed to limit leakage of the gas back to the atmosphere, at least until the fairing is deployed. At about T=40 ms the fairing is fully deployed and locked in place. The remaining high-pressure gun gasses 91 in the chamber and cylinder will bleed out through the plate orifice to the atmosphere.

Figure 7A:
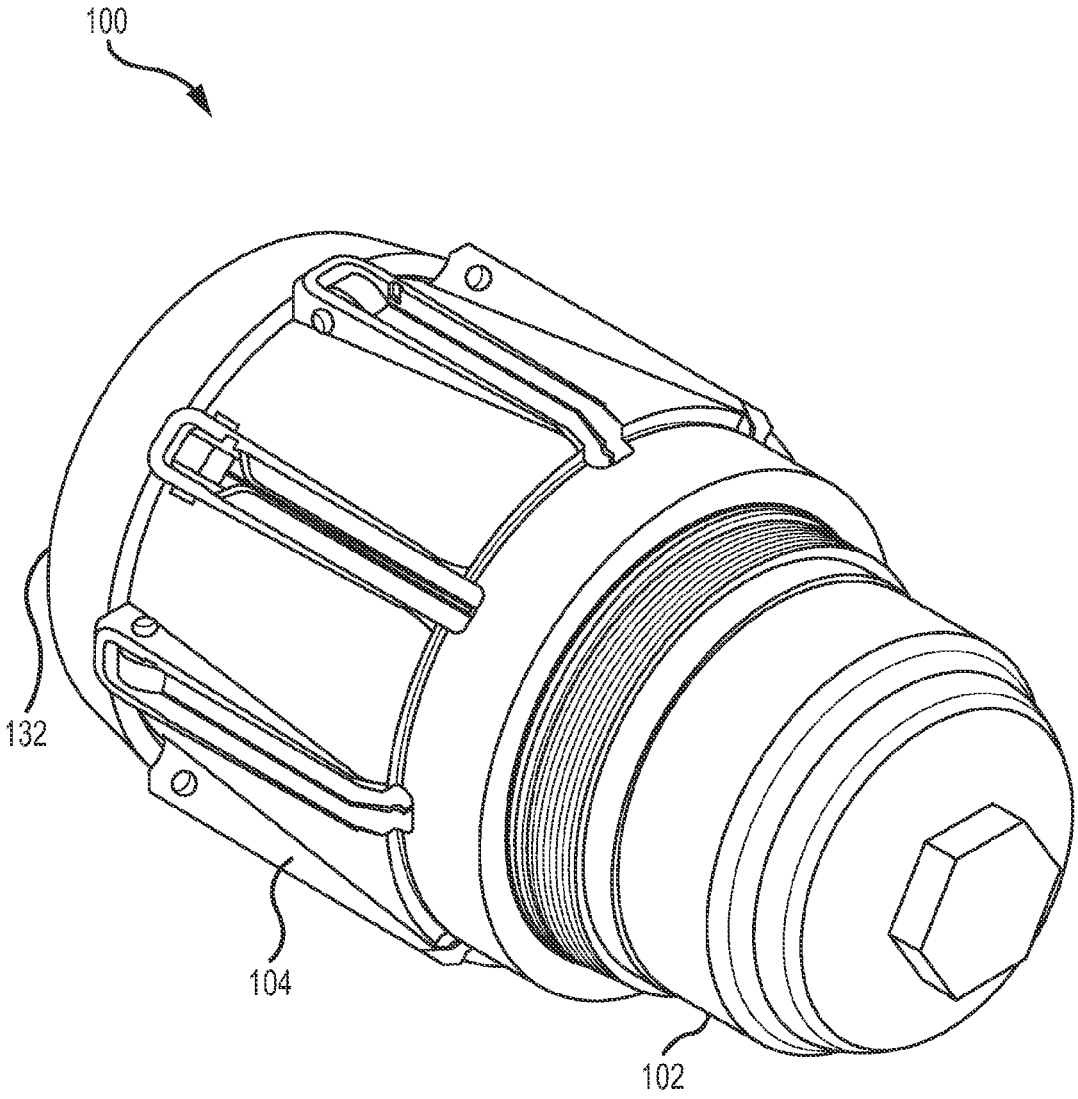
FIGS. 7*a* through 7*c* are isometric, section and exploded views of an embodiment of a deployable-fairing base assembly kit.
Figure 7B:
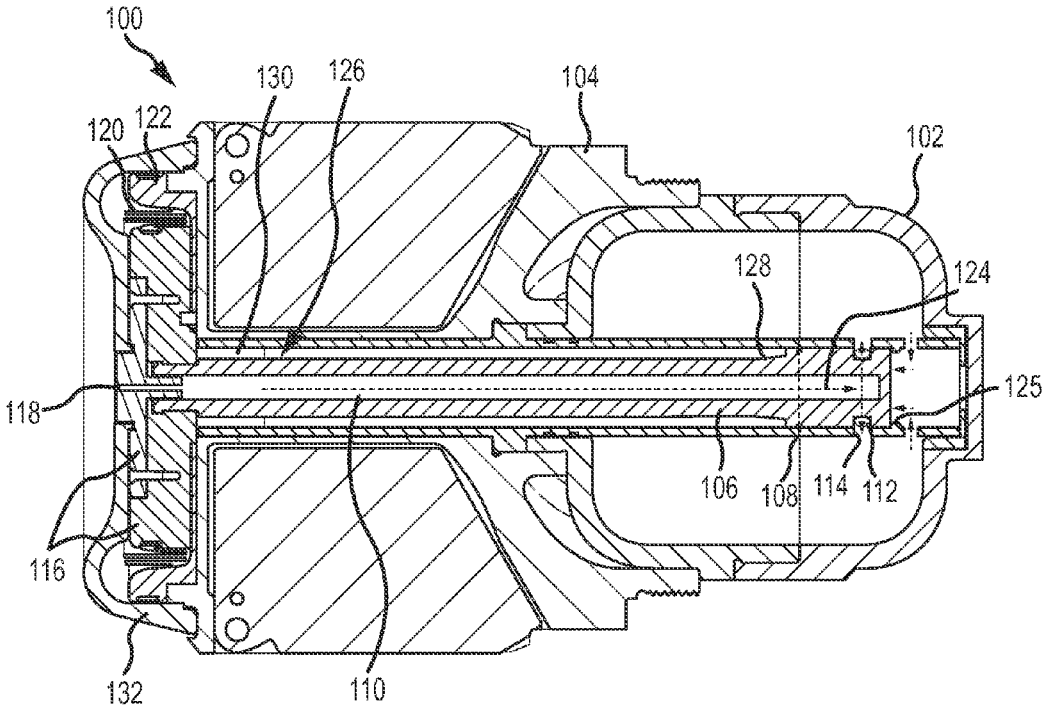
Figure 7C:
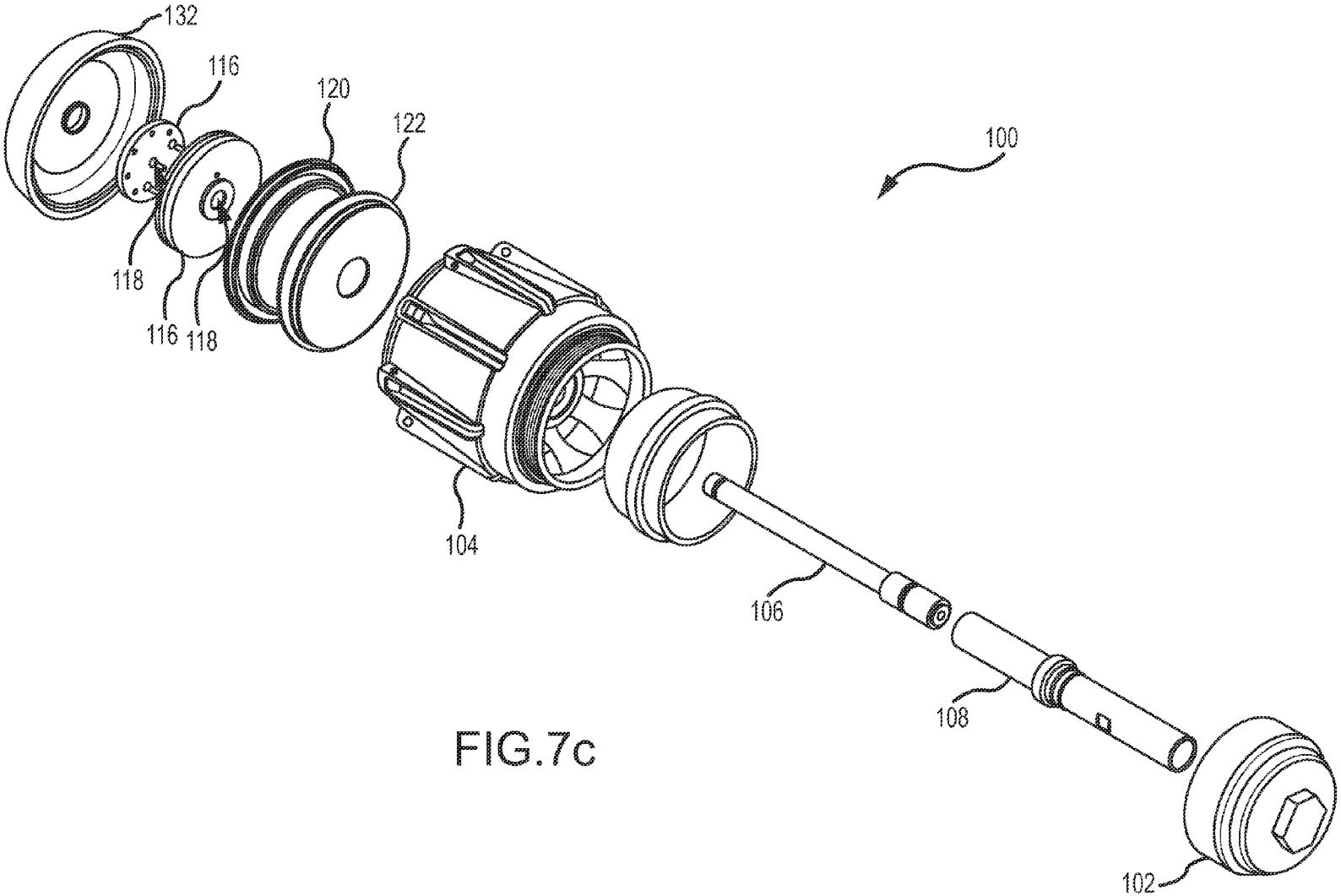

FIGS. 7*a* through 7*c* illustrate an embodiment of a base assembly kit 100 for use with an artillery shell having an aft void space. To use, the existing base assembly is detached from the shell and the base assembly kit 100 is threaded on to the shell. In this configuration, the chamber 102 may be mounted on the forward section of the base assembly 104 to engage the shell's aft void space.

Kit 100 includes base assembly 104, which may be similar if not identical to the standard base assembly ordinarily used with the shell. Depending on the original design of the base assembly it may or may not need to be modified to accommodate the piston/cylinder and chamber. The base assembly may require minor modifications to secure the fabric fairing the end cover.

In kit 100 chamber 102 is positioned on the base assembly forward complementary with the warhead's void space. A piston 106 and cylinder 108 extend axially through the base assembly into the chamber. The piston includes an axial orifice 110 along its length and one or more holes 112 that are aligned to one or more holes 114 in the cylinder when the piston is in a stowed state. An end plate 116 is attached to the aft end of the piston with an orifice 118 aligned with the axial orifice in the piston. End plate 116 may be a single integrated plate or two separate places as shown here. A fabric fairing 120 is fitted in the aft end of the base assembly in the stowed state; one end of the fairing is secured to the base assembly by a retaining ring 122 and the other end of the fairing secured to the end plate. The plate orifice 118, along the piston axial orifice 110 and through the aligned holes 112 and 114 in the piston and cylinder form a gas intake path 124. Alternately, a separate gas intake path may be formed directly into the chamber. Detents 125 may be affixed to the cylinder at the front surface of the piston (if needed) to prevent the piston from being driven forward during intake of the high-pressure gun gasses. Additional holes in the cylinder 114 in front of the top surface of the piston form a gas outlet path from the chamber into the cylinder above the piston. A locking mechanism 126 is provided to lock the fairing in the deployed state. Locking mechanism 126 may, as shown here, comprises complementary internal taper 128 of the cylinder and external taper 130 of the piston. Other alternative locking mechanisms are contemplated including a detent pin that engages the piston. A cover 132 covers the rear section of the base assembly to protect the fabric fairing from the gun gasses at launch. The cover falls away to allow the fairing to deploy.

Figure 8:
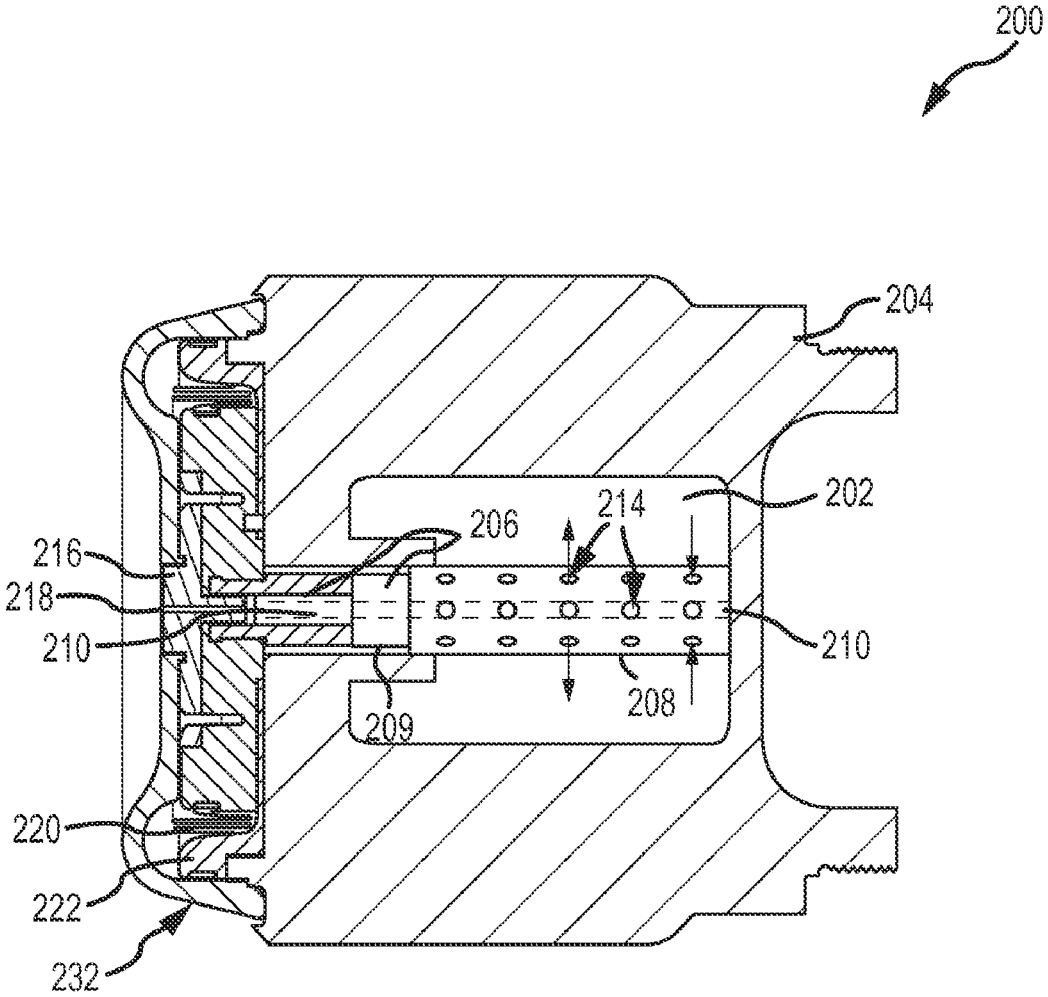
FIG. 8 is a section view of another embodiment of a deployable-fairing base assembly kit.

FIG. 8 illustrates an embodiment of a base assembly kit 200 for use with an artillery shell having a flat rear section. To use, the existing base assembly is detached from the shell and the base assembly kit 200 is threaded on to the shell. In this configuration, the chamber 202 is fully contained within the base assembly 204 around the piston/cylinder assembly. The piston 206 may be of fixed length or a telescoping configuration to increase the deployable length.

Kit 200 includes base assembly 204, which may be similar if not identical to the standard base assembly ordinarily used with the shell. Depending on the original design of the base assembly it may or may not need to be modified to accommodate the piston/cylinder and chamber. The base assembly may require minor modifications to secure the fabric fairing the end cover.

In kit 200 chamber 202 is positioned with the base assembly around the piston/cylinder assembly. A telescoping piston 206 and cylinder 208 extend axially through the base assembly and the chamber. Each section of the telescoping piston 206 suitably comprises a locking mechanism 209 such as a detent that locks the section in play once it is deployed. A fixed length piston and locking mechanism may be used if additional length is not required to deploy the fairing. The piston includes an axial orifice 210 along its length and one or more holes (not shown) that are aligned to one or more holes 214 in the cylinder when the piston is in a stowed state. Alternately, the orifice may extend through the top surface of the piston, and the top surface of the piston may be provided with castellations to allow gas to flow into and out of the chamber in front of the piston. An end plate 216 is attached to the aft end of the last section of the telescoping piston with an orifice 218 aligned with the axial orifice in the piston. End plate 216 may be a single integrated plate or two separate places as shown here. A fabric fairing 220 is fitted in the aft end of the base assembly in the stowed state; one end of the fairing is secured to the base assembly by a retaining ring 222 and the other end of the fairing secured to the end plate. The plate orifice 218, along the piston axial orifice 210 and through the aligned holes 212 and 214 in the piston and cylinder form a gas intake path. Alternately, a separate gas intake path may be formed directly into the chamber. The holes in the cylinder 214 in front of the top surface of the piston form a gas outlet path from the chamber into the cylinder. A cover 232 covers the rear section of the base assembly to protect the fabric fairing from the gun gasses at launch. The cover falls away to allow the fairing to deploy.

Figure 9A:
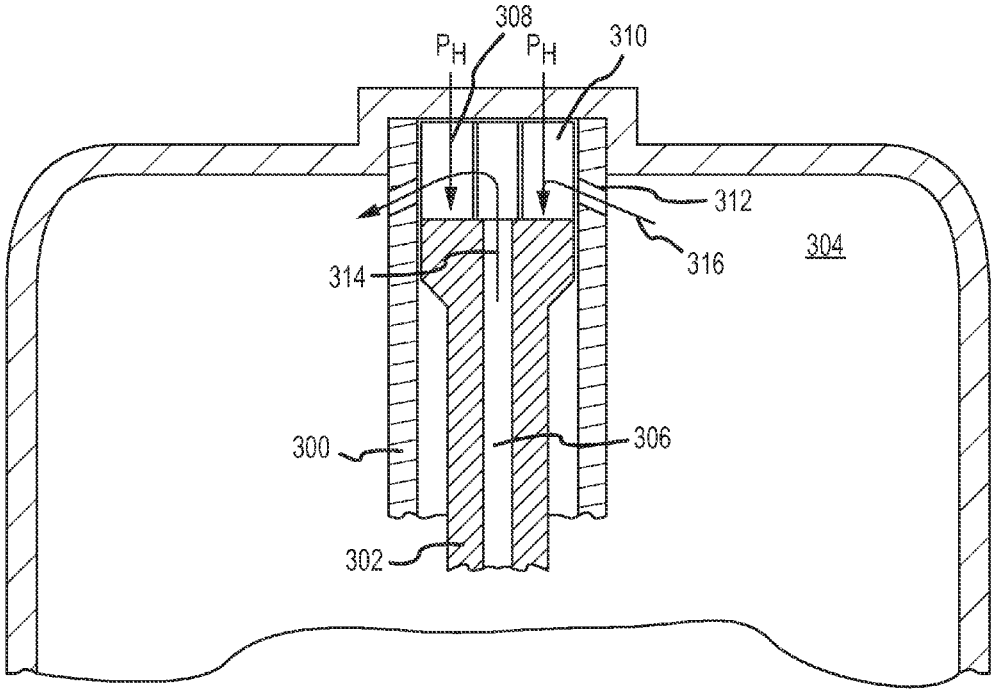
FIGS. 9*a* through 9*c* are a partial section view of a piston and cylinder, a cylinder and a piston provided with castellations, respectively, in an alternate embodiment.
Figure 9B:
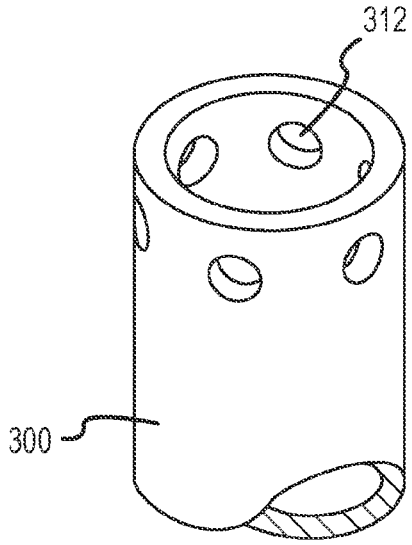
Figure 9C:
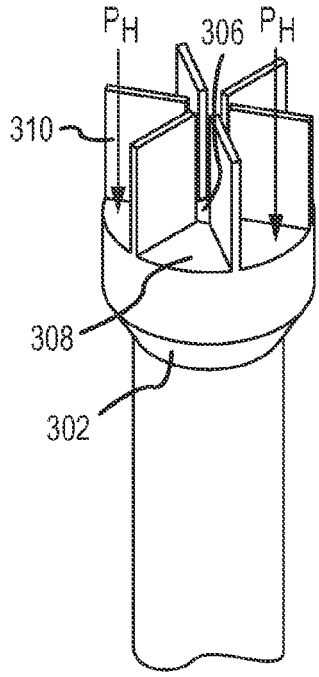

In another embodiment as shown in FIGS. 9*a* through 9*c*, a shell may include a cylinder 300 that guides a piston 302 and extends axially into a chamber 304. The gas intake path comprises an orifice 306 that extends through the plate, axially through a bore down the length of the piston to its top surface 308. Castellations 310 are positioned on the top surface of the piston around the orifice 306, suitably extending radially from the orifice at even intervals around the piston. The castellations provide a stand-off to the closed end of the cylinder and volume in front of the piston. The cylinder 300 includes a plurality of holes 312 suitably nominally aligned to the void spaces between adjacent castellations. During intake, high-pressure gun gas 314 flows down the orifice 306, between the castellations 310 and through the holes 312 in the cylinder into chamber 304. Once the shell clears the gun tube, the high-pressure gas 316 in the chamber is coupled through the holes in the cylinder and the castellations to pressurize the volume and act over the top surface 308 of the piston. That high-pressure $P_H$ (relative to the low-pressure aft of the shell) acting over the area at the top of the piston drives the piston aft.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A gun-launched artillery shell for launch from an artillery gun tube, comprising:

a payload;

a fabric fairing fitted in a rear section of the shell in a stowed state;

a chamber in a rear section of the shell;

a plate attached to a rear section of the fabric fairing;

a piston attached to the plate;

a locking mechanism; and a gas intake path to store high pressure gun gases in said chamber upon firing of the artillery shell from an artillery tube, said stored high pressure gun gases driving the piston aft into the locking mechanism to deploy the fairing once the shell clears the gun tube.

2. The artillery shell of claim 1, further comprising:

a cylinder along a long axis of the shell that extends into the chamber, said cylinder including one or more holes formed therein, said piston disposed within said cylinder, wherein the holes in the cylinder form a gas outlet path to expel the stored high-pressure gun gas from the chamber into the cylinder to drive the piston aft into the locking mechanism to deploy the fairing.

3. The artillery shell of claim 2, wherein the gas intake path comprises an orifice that extends through the plate, axially through the piston and through holes in the piston and the cylinder in the stowed state.

4. The artillery shell of claim 3, wherein the orifice extends axially through the piston to its top surface, further comprising:

a plurality of castellations arranged on the top surface of the piston about the orifice, void spaces between adjacent castellations coupling high pressure gun gases from the orifice through the holes in the cylinder to store the gases in the chamber in the stowed state, said high-pressure gases expelled from the chamber through the holes in the cylinder and through the castellations to apply pressure to a top surface of the piston to drive the piston aft.

5. The artillery shell of claim 2, wherein the locking mechanism comprises complementary tapers of the internal diameter of the cylinder and the external diameter of the piston.

6. The artillery shell of claim 2, wherein the diameter of the plate is less than the diameter of the rear section of the shell to reduce that base area and form or extend a boat-tail on the shell once deployed.

7. The artillery shell of claim 1, further comprising a base assembly that holds an obturator in place around the rear section of the warhead to engage an inner diameter of the artillery tube, said fabric fairing fitted in and attached to a rear section of the base assembly in the stowed state.

8. The artillery shell of claim 7, wherein a rear section of the warhead has a void space, said chamber positioned forward of the base assembly to engage said void space.

9. The artillery shell of claim 7, wherein said chamber is contained within the base assembly.

10. The artillery shell of claim 9, wherein the piston comprises a telescoping mechanism that extends beyond its stowed length when driven aft to deploy the fairing.

11. A base assembly kit for a gun-launched artillery shell launched from an artillery tube, comprising:

a base assembly;

a fabric fairing fitted in and attached to the aft end of the base assembly in a stowed state;

a chamber;

a plate attached to a rear section of the fabric fairing;

a piston having an aft surface attached to the plate and having a top surface;

a locking mechanism; and a gas intake path to store high pressure gun gases in said chamber upon firing of the artillery shell from an artillery tube, said stored high pressure gun gases acting on the top surface of the piston driving the piston aft into the locking mechanism to deploy the fairing once the shell clears the artillery tube.

12. The base assembly kit of claim 11, further comprising:

a cylinder along an axis of the base assembly that extends into the chamber, said cylinder including one or more holes formed therein, said piston disposed within said cylinder, wherein the holes in the cylinder form a gas outlet path to expel the stored high-pressure gun gas from the chamber into the cylinder to drive the piston aft into the locking mechanism to deploy the fairing.

13. The base assembly kit of claim 12, wherein the gas intake path comprises an orifice that extends through the plate, axially through the piston and through holes in the piston and the cylinder in the stowed state.

14. The base assembly kit of claim 13, wherein the orifice extends axially through the piston to its top surface, further comprising:

a plurality of castellations arranged on the top surface of the piston about the orifice, void spaces between adjacent castellations coupling high pressure gun gases from the orifice through the holes in the cylinder to store the gases in the chamber in the stowed state, said high-pressure gases expelled from the chamber through the holes in the cylinder and through the castellations to apply pressure to the top surface of the piston to drive the piston aft.

15. The base assembly kit of claim 13, wherein the holes in the piston are arranged in the sidewalls of the piston nominally aligned to holes in the cylinder in the stowed state to direct high-pressure gun gases into the chamber, once the shell clears the artillery tube said high-pressure gun gases are expelled from the chamber through holes in the cylinder to apply pressure to the top surface of the piston to drive the piston aft.

16. The base assembly kit of claim 12, wherein said chamber is positioned forward of the base assembly.

17. The base assembly kit of claim 12, wherein said chamber is contained within the base assembly.

18. A gun-launched artillery shell for launch from a gun tube, comprising:

a nose section including a fuze;

a warhead, said warhead having a threaded rear section that defines a void space;

an obturator around the rear section of the warhead to engage an inner diameter of the artillery tube; and a base assembly kit comprising:

a base assembly threaded onto the threaded rear section of the warhead holding the obturator in place;

a chamber positioned on the base assembly forward into the warhead's void space;

a cylinder that extends axially through the base assembly into the chamber, said cylinder including one or more holes formed therein;

a piston within the cylinder, said piston having an axial orifice along its length, said piston having one or more holes formed therein;

an end plate attached to the aft end of the piston, said plate having an orifice aligned with the axial orifice in the piston;

a fabric fairing fitted in the aft end of the base assembly in the stowed state, one end of the fairing secured to the base assembly and the other end of the fairing secured to the end plate; and a locking mechanism to lock the piston in a deployed state, wherein the plate orifice, along the piston axial orifice and through the holes in the piston and cylinder form a gas intake path to store high pressure gun gas in the chamber in the stowed state, and wherein the holes in the cylinder form a gas outlet path to expel the stored high-pressure gun gas from the chamber into the cylinder to produce a high pressure that drives the piston aft into the locking mechanism to deploy the fairing to the deployed state.

19. The artillery shell of claim 18, wherein the orifice extends axially through the piston to its top surface, further comprising:

a plurality of castellations arranged on the top surface of the piston about the orifice, void spaces between adjacent castellations coupling high pressure gun gases from the orifice through the holes in the cylinder to store the gases in the chamber in the stowed state, said high-pressure gases expelled from the chamber through the holes in the cylinder and through the castellations to apply pressure to the top surface of the piston to drive the piston aft.

20. A method of reducing aerodynamic drag on a gun-launched artillery shell, comprising:

providing an artillery shell having a fabric fairing and a piston attached thereto in a rear section of the shell in a stowed state and having a chamber;

loading the artillery shell into an artillery tube;

deflagrating a propellant inside the artillery tube to produce high-pressure gun gases to launch the shell from the artillery tube;

during launch of the artillery shell from the artillery tube, capturing and storing high-pressure gun gases in the chamber;

once the shell clears the end of the artillery tube, said stored high-pressure gun gases driving the piston aft to deploy the fabric fairing attached thereto to reduce the boat-tail area of the shell; and engaging a locking mechanism to lock the piston in a deployed position.

* * * * *